US005440955A

United States Patent [19]

Freeland

[11] Patent Number: 5,440,955

[45] Date of Patent: Aug. 15, 1995

[54] MULTI-PURPOSE STRAP WRENCH

[76] Inventor: Gregory A. Freeland, P.O. Box 60606, Colorado Springs, Colo. 80960

[21] Appl. No.: 194,977

[22] Filed: Feb. 14, 1994

[51] Int. Cl.[6] ..... B25B 13/52

[52] U.S. Cl. ..... 81/64

[58] Field of Search ..... 81/64, 3.43, 65, 65.2, 81/68, 69, 177.1, 177.2, 177.85

[56] References Cited

U.S. PATENT DOCUMENTS

| | | | |
|---|---|---|---|
| 2,995,965 | 8/1961 | Hockney | 81/64 |
| 3,686,984 | 8/1972 | Kelso | 81/64 |
| 3,838,615 | 10/1974 | McFarland et al. | 81/64 |
| 4,037,495 | 7/1977 | Beckstead | 81/64 |
| 4,114,481 | 9/1978 | Kowalczyk | 81/64 |
| 4,750,389 | 6/1988 | Shuster | 81/64 |
| 4,768,405 | 9/1988 | Nickipuck | 81/177.85 |
| 4,913,010 | 4/1990 | Doss | 81/64 |
| 5,056,383 | 10/1991 | Halpin | 81/3.43 |
| 5,090,274 | 2/1992 | Schaub | 80/64 |
| 5,115,700 | 5/1992 | Kaler, II | 81/64 |
| 5,295,420 | 3/1994 | Grimes | 81/3.43 |

*Primary Examiner*—Bruce M. Kisliuk
*Assistant Examiner*—Joni Danganan
*Attorney, Agent, or Firm*—Henderson & Sturm

[57] ABSTRACT

A multi-purpose strap wrench which utilizes an attachable oil filter claw for easy adaption for particular use with oil filters. The wrench may utilize a standard strap wrench type handle, or the handle may be removed and a rachet or torque wrench may be used. The invention further utilizes an easily adjustable strap provided with hook and loop fasteners for convenient adjustment about the item to be turned.

7 Claims, 3 Drawing Sheets

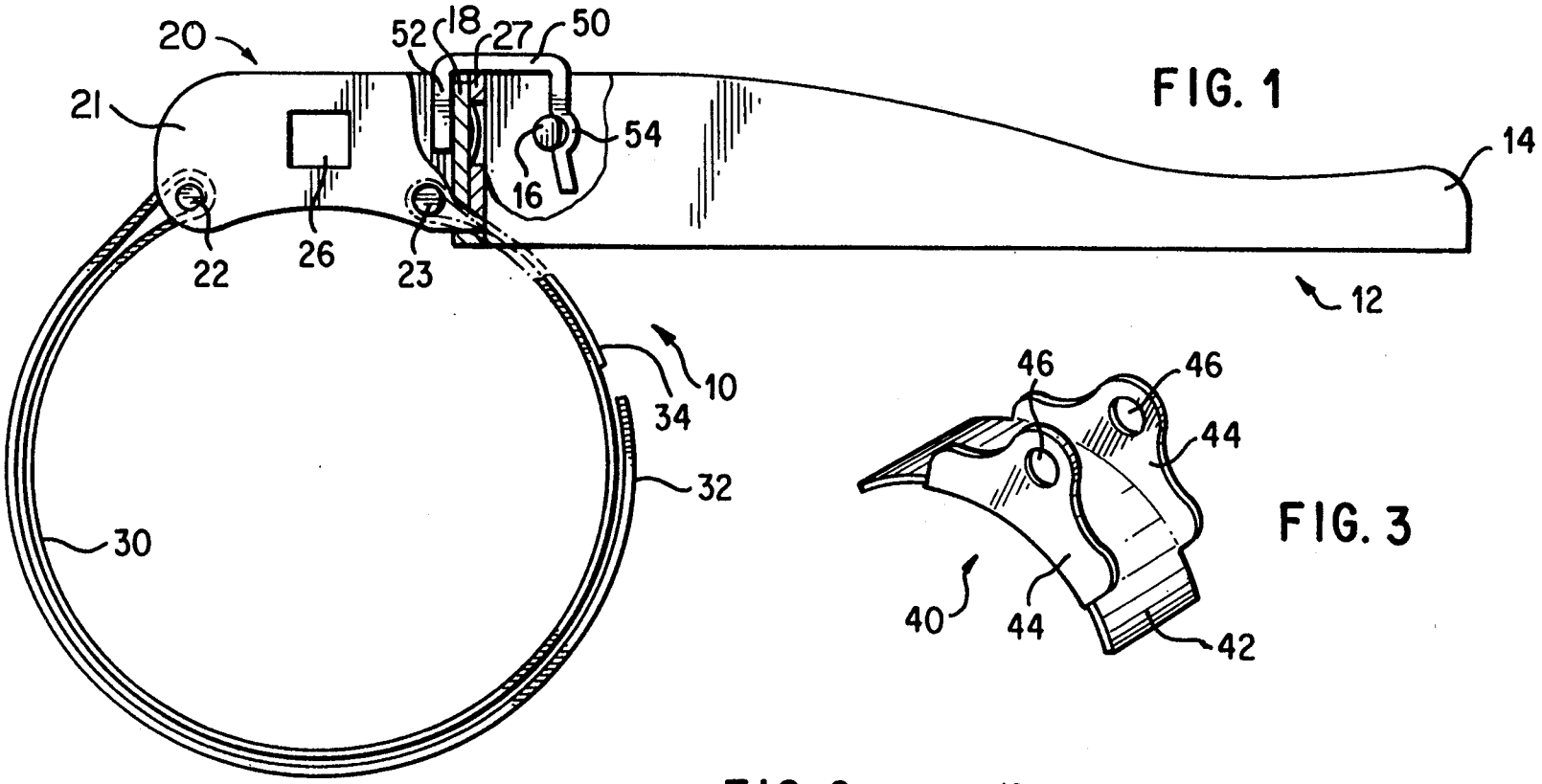
FIG. 1
FIG. 3
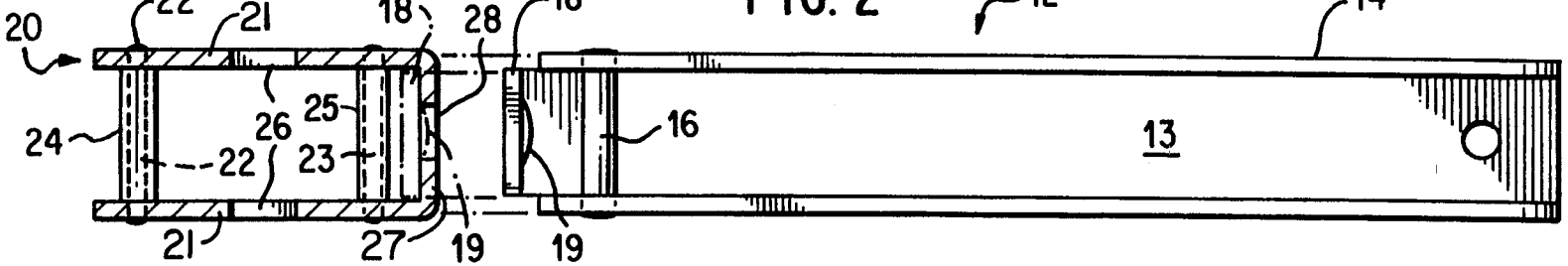
FIG. 2

MULTI-PURPOSE STRAP WRENCH

TECHNICAL FIELD

This invention relates to a strap wrench, and more particularly to a strap wrench which is adaptable for use as an oil filter wrench and has a removable handle for operation with a rachet handle or torque wrench.

BACKGROUND ART

Oil filter wrenches are well known in the art, but these wrenches are ordinarily made to fit a particular size of oil filter. Thus when one has engines which require different sizes of oil filter, he must also have a number of different oil filter wrenches. Further, standard oil filter wrenches come with a handle permanently attached thereto and are often very difficult to use when sufficient space is not available in the engine compartment. U.S. Pat. No. 5,090,274 teaches an oil filter wrench which utilizes a rachet or torque wrench, but that device cannot accommodate a standard wrench handle. Strap wrenches are also well known in the art, but these are not suitable for use on oil filters since they have no provision for an oil filter claw which is required to prevent crushing of the filter.

DISCLOSURE OF THE INVENTION

The present invention teaches a multi-purpose strap wrench which utilizes an attachable oil filter claw for easy adaption for particular use with oil filters. The wrench may utilize a standard strap wrench type handle, or the handle may be removed and a rachet or torque wrench may be used. The invention further utilizes an easily adjustable strap comprised of hook and loop fasteners for convenient adjustment about the item to be turned.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

FIG. 1 is a side elevational view of the invention utilizing a wrench handle;

FIG. 2 is a top view of the invention, in partial section, showing the wrench handle separated from the base member;

FIG. 3 is a perspective view of the oil filter claw;

BEST MODE FOR CARRYING OUT THE INVENTION

Figure 4:
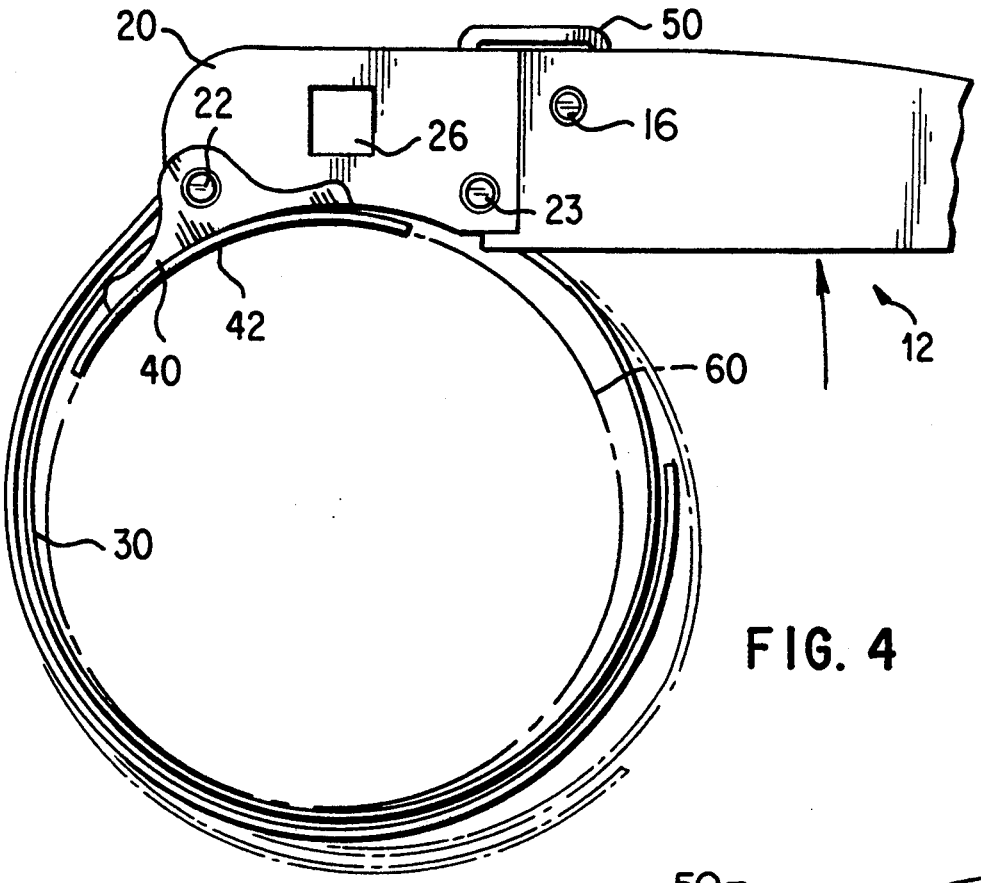
FIG. 4 is a side elevational view of the invention utilizing the oil filter claw and wrench handle while the strap is adjusted about the oil filter.

Referring now to the drawings, wherein like reference numerals designate identical or corresponding parts throughout the several views, the invention is designated generally as 10 and is basically comprised of a handle 12, a base member 20, and a strap 30. The handle 12 may be formed from a flat sheet of steel, heavy aluminum, or the like, cut into the proper form and bent into a U-shape with a bottom section 13 and two sides 14. This handle 12 is also provided with an extension 18, perpendicular to the sides 14, and spaced sufficiently from the sides so as to accommodate the cross plate 27 of the base member 20 as will be described below. The handle 12 is also provided with a spacer assembly 16 to maintain the handle 12 in its proper configuration.

The base member 20 is a U-shaped structure also formed from steel, heavy aluminum, or the like, with opposite flanges or sides 21 and a crossplate 27. The base member 20 has a pair of strap retainers comprised of pins 22, 23 and spacers 24, 25 The two flanges 21 each have a square aperture 26 formed therein to accommodate a rachet handle or other torque tool when the handle 12 is not to be used. The base member crossplate 27 also has an aperture 28 formed therein for receiving a protrusion 19 formed or punched into extension 18, for the purpose of locking the handle 12 onto the base member 20 when the crossplate 27 is inserted into the gap between extension 18 and handle sides 14. The handle 12 is further secured in place by means of snap pin 50 with a forward lip 52 which slides inside the crossplate 27 and a clip 54 which snaps over the handle spacer assembly 16.

An oil filter claw 40 is depicted in FIG. 3 and is comprised of base 42 which substantially conforms with the shape of standard oil filters, and two opposite flanges 44. Each of the flanges 44 has an aperture 46 formed therein so that the claw 40 may be removably and pivotally affixed over the strap retainer spacer 24.

The adjustable length strap 30 is fabricated from nylon or other strong, flexible material and has a loop formed near end 34 which is permanently secured around pin 23 (FIG. 1) with end 34 sewn or riveted to the strap after forming the loop. The strap then extends to pass around pin 22 and is looped back upon itself and is secured by means of conventional hook and loop fasteners which are sewn onto the strap.

Figure 5:
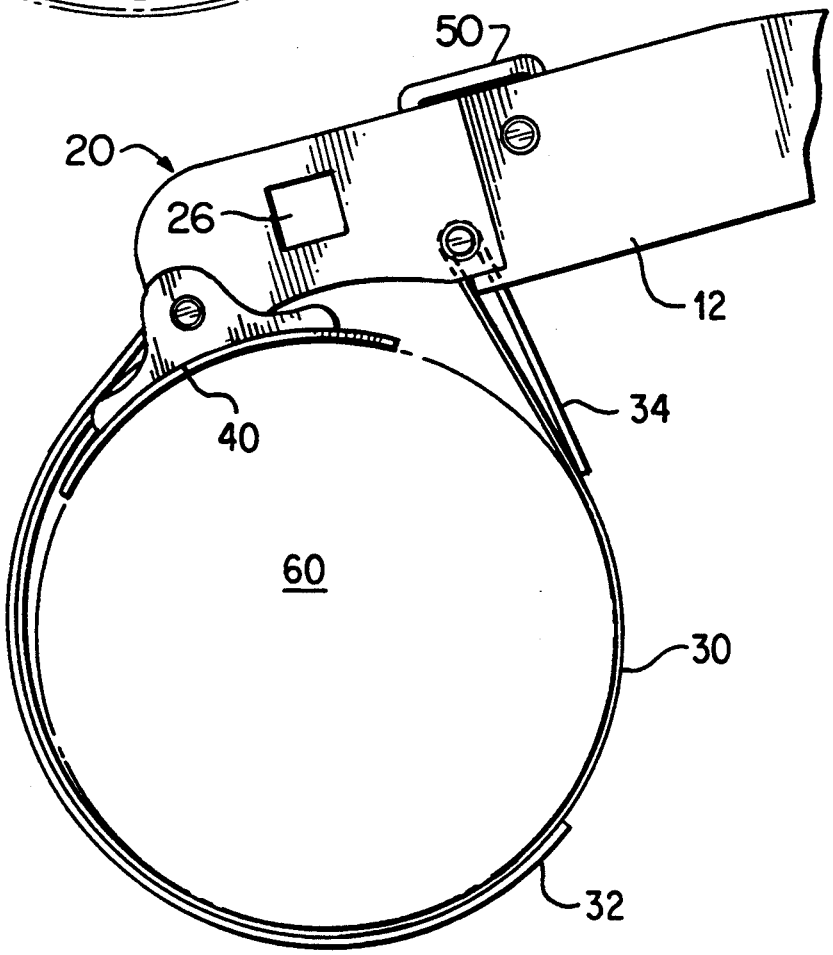
FIG. 5 is a side elevational view of the invention in actual use.
Figure 6:
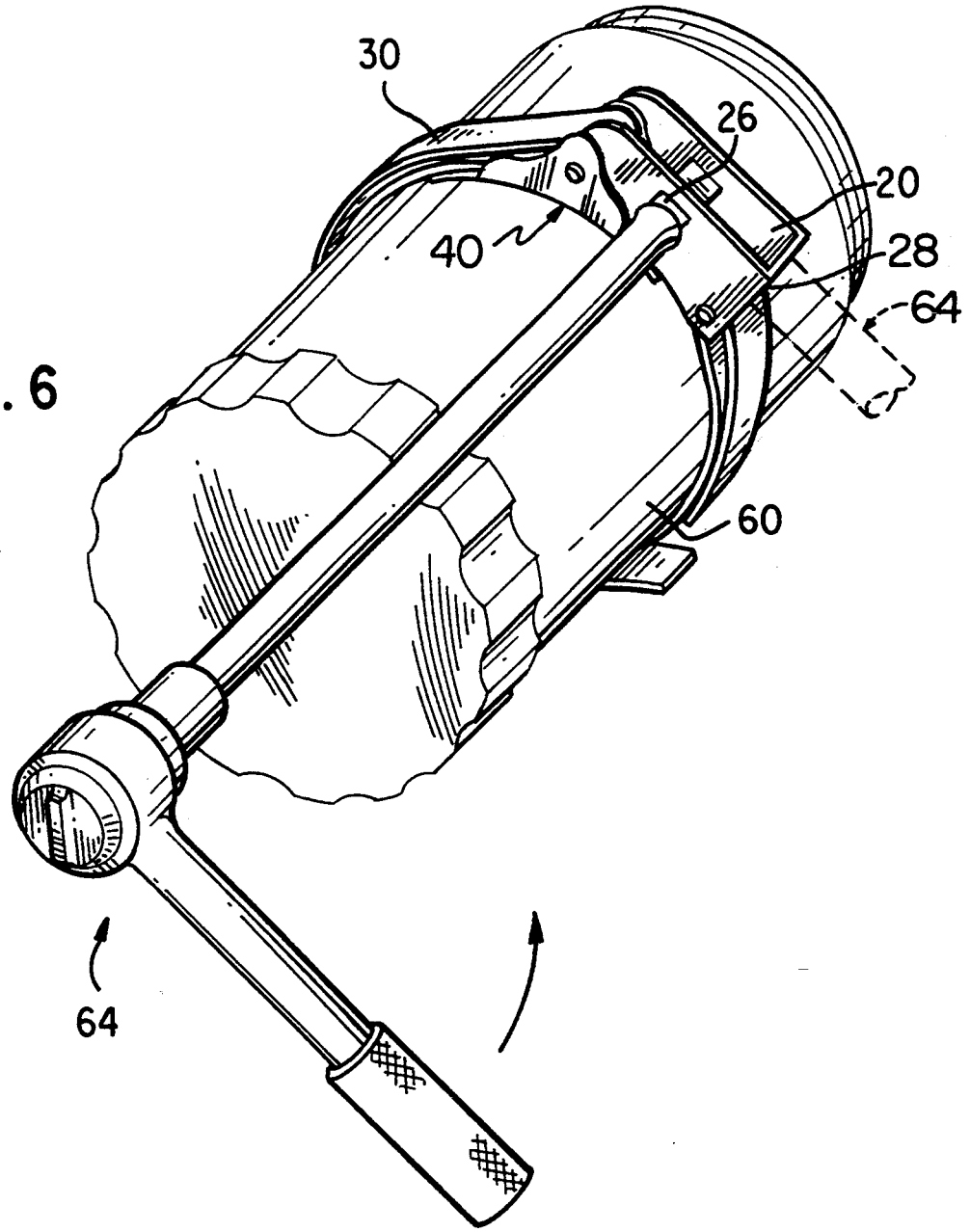
FIG. 6 is a perspective view of the invention on an oil filter and utilizing the alternate rachet handle.

Operation of the invention is best seen in FIG. 4 and FIG. 5 where the strap 30 is shown placed around an object to be turned (as an oil filter) 60. The hook and loop fasteners are first released so that the strap may be cinched up around the filter, and then are re-engaged as the strap is looped back upon itself. The handle is then rotated upward, or counterclockwise, and will rotate the filter as desired. As seen in FIG. 6, the handle 12 can be removed if necessary. due to a lack of space, and the strap wrench can be turned by means of a Standard rachet handle or torque wrench 64 inserted into the apertures 26, Also, of course, the oil filter claw may also be easily removed from spacer 24 and the invention can be used as a standard strap wrench.

Obviously, many modifications and variations of the present invention are possible in light of the above teachings. It is therefore to be understood that, within the scope of the appended claims, the invention may be practiced otherwise than as specifically described.

I claim:

1. A multi-purpose strap wrench, comprising:

(a) a base member comprising a first flange, a second flange, and a crossplate provided with an aperture and connecting said first and second flanges, said first and second flanges having first and second strap retainers extending therebetween and a pair of opposed apertures passing therethrough wherein the apertures are dimensioned to receive means for applying external force to said base member; and (b) an adjustable-length elongated strap operably connected to said strap retainers.

2. The multi-purpose strap wrench as recited in claim 1, further comprising a wrench handle removably secured to one portion of said base member.

3. The multi-purpose strap wrench as recited in claim 2, further comprising a filter claw removably coupled to another portion of said base member.

4. The multi-purpose strap wrench as recited in claim 3, wherein said adjustable-length elongate strap includes hook and loop fasteners.

5. The multi-purpose strap wrench as recited in claim 2; wherein, a portion of said wrench handle is dimensioned to be received by said crossplate.

6. The multi-purpose strap wrench as recited in claim 2 further including;

means for releasably engaging said wrench handle to said base member.

7. The multi-purpose strap wrench as recited in claim 1; wherein, one portion of said elongated strap is permanently secured to said base member and the other end of said elongated strap, is releasably secured to said base member.

* * * * *